US012426762B2

(12) United States Patent
Gu et al.

(10) Patent No.: US 12,426,762 B2
(45) Date of Patent: Sep. 30, 2025

(54) CLEANING DEVICE WITH WATER PUMPING DEVICE WITHIN MAIN WATER TANK

(71) Applicant: BEIJING XIAOMI MOBILE SOFTWARE CO., LTD., Beijing (CN)

(72) Inventors: Erdong Gu, Beijing (CN); Fengfeng Lu, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 355 days.

(21) Appl. No.: 17/976,503

(22) Filed: Oct. 28, 2022

(65) Prior Publication Data

US 2024/0032764 A1 Feb. 1, 2024

(30) Foreign Application Priority Data

Jul. 29, 2022 (CN) ..... 202221996622.0

(51) Int. Cl.
*A47L 11/40* (2006.01)

(52) U.S. Cl.
CPC ..... *A47L 11/4083* (2013.01); *A47L 11/4088* (2013.01); *A47L 11/4036* (2013.01)

(58) Field of Classification Search
CPC .. A47L 11/40; A47L 11/4016; A47L 11/4036; A47L 11/4083; A47L 11/4088
See application file for complete search history.

(56) References Cited

U.S. PATENT DOCUMENTS

| | | | | |
|---|---|---|---|---|
| 2021/0169297 | A1 | 6/2021 | Jang et al. | |
| 2021/0186290 | A1* | 6/2021 | Feng | A47L 11/4027 |
| 2022/0079408 | A1* | 3/2022 | Huang | A47L 11/4083 |
| 2022/0095873 | A1* | 3/2022 | Luo | A47L 11/4088 |

FOREIGN PATENT DOCUMENTS

| | | | | |
|---|---|---|---|---|
| CN | 204026624 U | | 12/2014 | |
| CN | 207768315 U | * | 8/2018 | |
| CN | 208144970 U | * | 11/2018 | |
| CN | 113080779 A | * | 7/2021 | A47L 1/02 |
| CN | 114027738 A | * | 2/2022 | |
| WO | WO 2022036790 A1 | | 2/2022 | |

OTHER PUBLICATIONS

European Patent Application No. 22204762.3, Search and Opinion dated May 22, 2023, 6 pages.

* cited by examiner

*Primary Examiner* — C. A. Rivera
(74) *Attorney, Agent, or Firm* — Cozen O'Connor

(57) ABSTRACT

A water tank assembly includes a main water tank and an auxiliary water tank. A water pumping device in operation pumps and discharges water in a first water storage space of the main water tank into a second water storage space of the auxiliary water tank. A water guiding device in operation outputs water from the second water storage space to a preset position. The water pumping device in operation can supply water to the auxiliary water tank as needed. The main water tank does not discharge water into the auxiliary water tank when the water pumping device is not in operation. As a result, the water amount in the auxiliary water tank no longer increases.

17 Claims, 2 Drawing Sheets

CLEANING DEVICE WITH WATER PUMPING DEVICE WITHIN MAIN WATER TANK

CROSS-REFERENCE TO RELATED APPLICATION

This application is based on and claims priority to Chinese Patent Application No. 202221996622.0 filed on Jul. 29, 2022, the entire content of which is incorporated herein by reference for all purposes.

BACKGROUND

A cleaning device such as an intelligent sweeping-mopping robot can automatically perform household cleaning, including sweeping, dedusting, and mopping, which greatly saves a homeowner's time cleaning the house. A water tank is a major component of the cleaning device, and may automatically replenish water to a rag of the cleaning device during a sweeping-mopping process.

In the related art, the water tank of the cleaning device is typically an electrically controlled water tank or a bionic water tank. The electrically controlled water tank controls quantitative water replenishment of a water pump through a software program, and is unable to adaptively adjust the replenished water amount. The bionic water tank outputs water through a water-absorbent cartridge by using the principle of differential air pressures between the inside and the outside. When the water tank is not in use, water continues dripping from the water tank and makes the rag wet, which causes problems such as smelly rags, floor damage and waste of water.

SUMMARY

The present disclosure relates to the field of smart home technology, and more particularly, to a water tank assembly, a cleaning device, and a cleaning system.

A first aspect of the present disclosure provides a water tank assembly. The water tank assembly includes: a main water tank including a first water storage space; an auxiliary water tank including a second water storage space; a water pumping device including a pumping port and a drainage port, the pumping port being in communication with the first water storage space, and the drainage port being in communication with the second water storage space to pump and discharge water in the first water storage space into the second water storage space; and a water guiding device including an inlet and an outlet structure, the inlet being in communication with the second water storage space, and the outlet structure being in communication with an exterior of the water tank assembly to output water in the second water storage space.

A second aspect of the present disclosure provides a cleaning device. The cleaning device includes: a main machine; a water tank assembly assembled on the main machine; and a cleaning body assembled on the water tank assembly and corresponding to a position of the outlet structure. The water tank assembly includes: a main water tank including a first water storage space; an auxiliary water tank including a second water storage space; a water pumping device including a pumping port and a drainage port, the pumping port being in communication with the first water storage space, and the drainage port being in communication with the second water storage space to pump and discharge water in the first water storage space into the second water storage space; and a water guiding device including an inlet and an outlet structure, the inlet being in communication with the second water storage space, and the outlet structure being in communication with an exterior of the water tank assembly to output water in the second water storage space.

A third aspect of the present disclosure provides a cleaning system. The cleaning system includes: a base station and a cleaning device fitted in or separated from the base station. The cleaning device includes: a main machine; a water tank assembly assembled on the main machine; and a cleaning body assembled on the water tank assembly and corresponding to a position of the outlet structure. The water tank assembly includes: a main water tank including a first water storage space; an auxiliary water tank including a second water storage space; a water pumping device including a pumping port and a drainage port, the pumping port being in communication with the first water storage space, and the drainage port being in communication with the second water storage space to pump and discharge water in the first water storage space into the second water storage space; and a water guiding device including an inlet and an outlet structure, the inlet being in communication with the second water storage space, and the outlet structure being in communication with an exterior of the water tank assembly to output water in the second water storage space.

DETAILED DESCRIPTION

Figure 1:
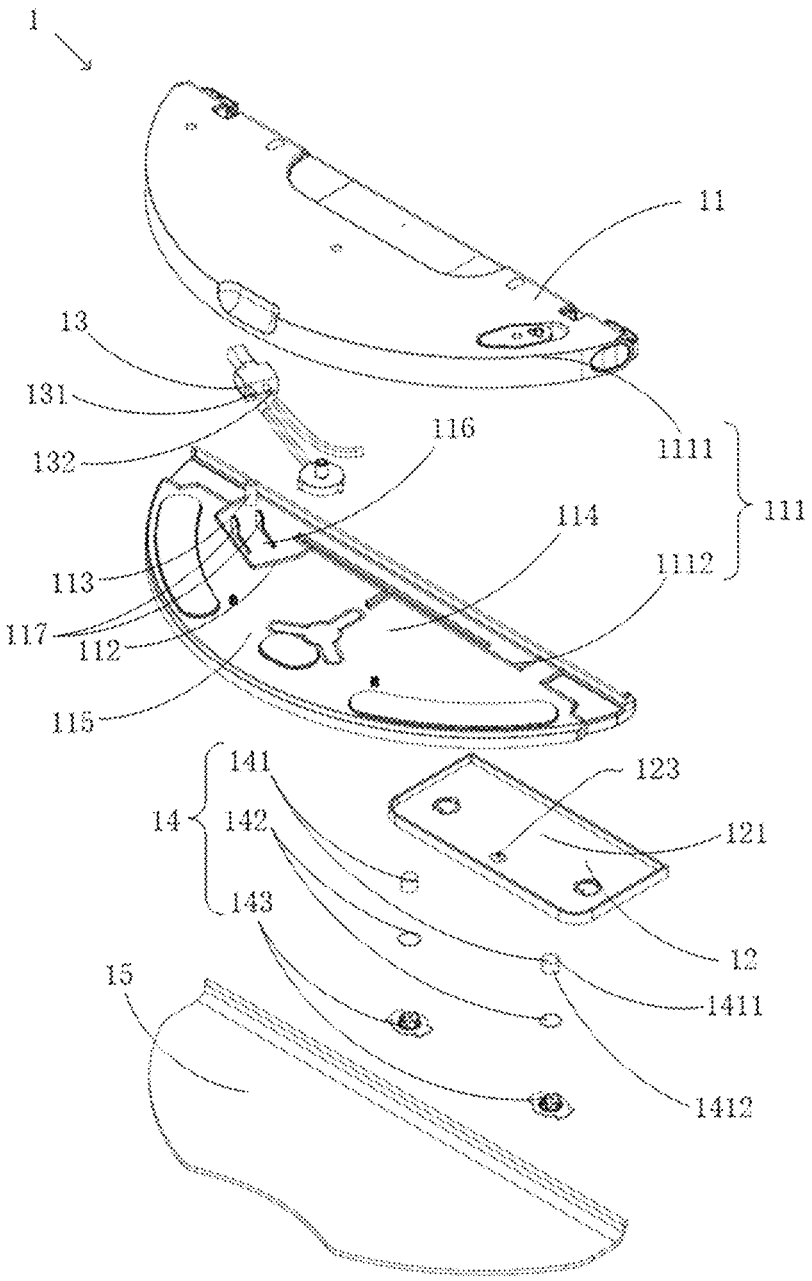
FIG. 1 is an exploded view of a water tank assembly according to an embodiment of the present disclosure.

Some embodiments will be described in detail, with examples thereof illustrated in the accompanying drawings. The following description refers to the accompanying drawings in which the same numbers in different drawings represent the same or similar elements unless otherwise represented. The implementations set forth in the following description of the embodiments do not represent all implementations consistent with the present disclosure. Instead, they are merely examples of devices and methods consistent with some aspects of the present disclosure.

Terms used in the present disclosure are only for the purpose of describing specific embodiments and are not intended to limit the present disclosure. Unless otherwise defined, technical terms or scientific terms used herein shall be understood in the ordinary sense as appreciated by those of ordinary skills in the art to which the present application belongs. Terms such as "first" and "second" used in the present disclosure are not intended to indicate any sequence, quantity or significance of indicated technical features, and are merely used to distinguish different elements. Likewise, the words "a," "an" and the like used herein are not intended to limit the quantity but indicate the presence of at least one element or device referred to by the words. It will be particularly specified when there is only one element or device. Terms such as "a plurality of" and "several" mean two or more than two. Terms such as "front," "rear," "lower" and/or "upper," "top," "bottom" and the like are merely for the convenience of description and not limited to a certain position or a certain orientation, unless indicated otherwise. Terms like "comprising" and "containing" mean that the elements or objects before these terms "comprising" or "containing" includes the elements or objects listed after the terms "comprising" or "containing" and do not exclude other elements or articles. Terms such as "connected" and "coupled" are not limited to physical or mechanical connection, but may include electrical connection, regardless of direct connection or indirect connection.

A cleaning device such as an intelligent sweeping-mopping robot can automatically complete household cleaning, including sweeping, dedusting, and mopping, which leaves the hands free and greatly saves time. A water tank is a main component of the cleaning device, and may automatically replenish water to a rag of the cleaning device during a sweeping-mopping process.

In the related art, the water tank of the cleaning device is basically an electrically controlled water tank or a bionic water tank. The electrically controlled water tank controls quantitative water replenishment of a water pump through a software program, and is unable to adaptively adjust the replenished water amount. The bionic water tank outputs water through a water-absorbent cartridge by using a principle of an air pressure difference between the inside and the outside. When the water tank is not in use, water continues dripping from the water tank and makes the rag wet, which causes problems of smelly rags, floor damage and waste of water.

Figure 2:
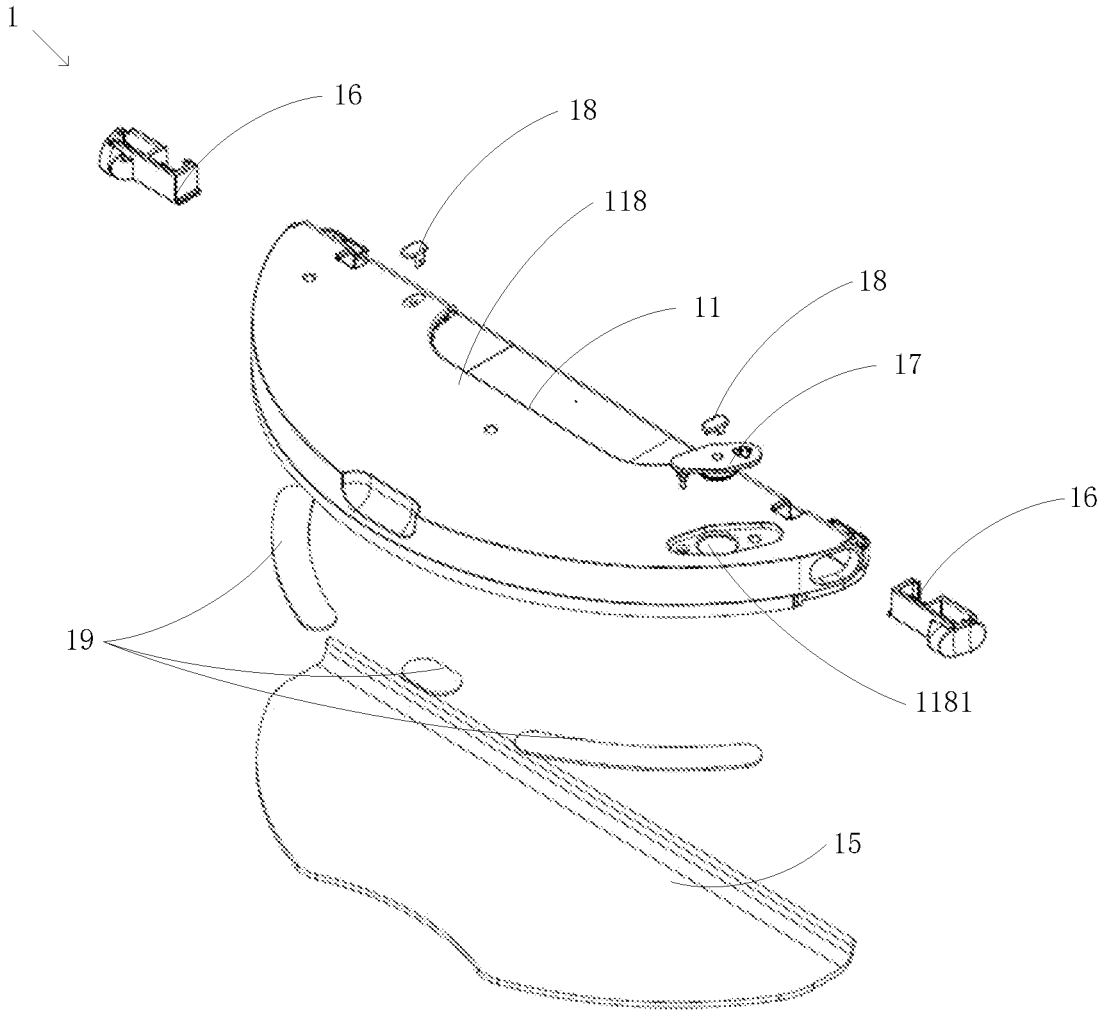
FIG. 2 is an exploded view of a water tank assembly according to another embodiment of the present disclosure.

The present disclosure provides a water tank assembly. FIG. 1 is an exploded view of a water tank assembly according to an embodiment of the present disclosure, and FIG. 2 is an exploded view of a water tank assembly according to another embodiment of the present disclosure. As shown in FIGS. 1 and 2, the water tank assembly 1 includes a main water tank 11, an auxiliary water tank 12, a water pumping device 13, and a water guiding device 14. The main water tank 11 has a first water storage space 115, and the auxiliary water tank 12 has a second water storage space 121. The water pumping device 13 includes a pumping port 131 and a drainage port 132. The pumping port 131 is in communication with the first water storage space 115, and the drainage port 132 is in communication with the second water storage space 121, to pump and discharge the water in the first water storage space 115 into the second water storage space 121. The water guiding device 14 includes an inlet 1411 and an outlet structure 1412. The inlet 1411 is in communication with the second water storage space 121, and the outlet structure 1412 is in communication with an exterior of the water tank assembly 1, to output water in the second water storage space 121.

The above water tank assembly 1 includes the main water tank 11 and the auxiliary water tank 12. The water pumping device 13 in operation pumps the water in the first water storage space 115 of the main water tank 11 into the second water storage space 121 of the auxiliary water tank 12. The water guiding device 14 in operation outputs the water from the second water storage space 121 to a preset position. The water pumping device 13 in operation supplies water to the auxiliary water tank 12 as needed. The main water tank 11 does not discharge water into the auxiliary water tank 12 when the water pumping device 13 is not in operation. As a result, the water amount in the auxiliary water tank 12 no longer increases, avoiding making the surroundings and device wet and avoiding the waste of water resources caused by continuous output of the water from the second water storage space 121.

In the above embodiment, the water pumping device 13 may be electrically coupled to a mainboard of the cleaning device, to automatically pump and discharge water through the control of the mainboard. For example, the mainboard may control the amount of water pumped and discharged, the pumping and discharging time, start-up, shutdown and other actions of the water pumping device 13, to add water into the second water storage space 121. It should be noted that the above water pumping and discharging process of the water pumping device 13 may be automatically controlled according to a preset procedure. For example, the water is added into the second water storage space 121 at a determined time and in a quantitative manner during operation of the cleaning device, and for example, the addition of water into the second water storage space 121 is stopped when the cleaning device is about to stop operating.

In some embodiments, the main water tank 11 includes a first housing 111, and the water pumping device 13 is in the first housing 111. The arrangement of the water pumping device 13 in the first housing 111 simplifies the overall structure of the water tank assembly 1 and facilitates the connection between the water pumping device 13 and the first water storage space 115.

In the above embodiments, the first housing 111 includes the first water storage space 115, an assembling space 116, and a partition structure separating the first water storage space 115 from the assembling space 116. The water pumping device 13 is in the assembling space 116. Since the first water storage space 115 and the assembling space 116 are separated by the partition structure, the water in the first water storage space 115 is prevented from entering the water pumping device 13 and damaging the water pumping device 13. The assembling space 116 includes a limiting structure 117 to limit and fix the position of the water pumping device 13 through the limiting structure 117.

The first housing 111 includes a first cover 1111 and a second cover 1112. The first cover 1111 and the second cover 1112 are fixed with each other by welding to form the sealed first water storage space 115. The partition structure includes a welding rib 112 on at least one of the first cover 1111 and the second cover 1112. The sealed first water storage space 115 is formed by the welding rib 112 of at least one of the first cover 1111 and the second cover 1112, improving the sealing of the first water storage space 115 and avoiding water leakage from the first water storage space 115. The above welding process may be ultrasonic welding.

The welding rib 112 may form a regular structural shape to improve the convenience of welding. The welding rib 112 may form a shape matching a structure of the water pumping device 13 based on the structure of the water pumping device 13, to improve the structural compactness of the main water tank 11.

In some embodiments, the main water tank 11 includes a bottom plate 114 facing the auxiliary water tank 12, and the auxiliary water tank 12 is on the bottom plate 114, to facilitate the connection between the second water storage space 121 of the auxiliary water tank 12 and the main water tank 11 through the water pumping device 13. The arrangement of the auxiliary water tank 12 on the bottom plate 114 further helps to make the overall structure of the water tank assembly 1 compact and facilitates the installation of the water tank assembly 1 to the cleaning device. The bottom plate 114 includes a drainage structure 113 that allows an interior of the main water tank 11 to be in communication with the second water storage space 121. The drainage port 132 is coupled to the drainage structure 113. Since the drainage structure 113 on the bottom plate 114 makes the drainage port 132 in communication with the second water storage space 121, the connection reliability and the assembly convenience of the water pumping device 13 and the second water storage space 121 can be guaranteed. The drainage structure 113 may be a tubular channel structure on the bottom plate 114, and the drainage port 132 of the water pumping device 13 may be in communication with the tubular channel structure through a hose and the like. The tubular channel structure may be in communication with the second water storage space 121 by snap fit, welding or in other ways, for the ease of assembly.

In some embodiments, the water guiding device 14 includes a main body 141, a sealing member 142, and an assembly bracket 143. The inlet 1411 and the outlet structure 1412 are on the main body 141. The main body 141 is assembled on the assembly bracket 143. The sealing member 142 is between the main body 141 and the assembly bracket 143. The water guiding device 14 is assembled on the auxiliary water tank 12 through the assembly bracket 143. The water guiding device 14 may be fixedly assembled on the auxiliary water tank 12 through the assembly bracket 143, improving the mounting reliability of the water guiding device 14. The sealing member 142 is between the main body 141 and the assembly bracket 143 to avoid water leakage between the main body 141 and the assembly bracket 143. The outlet structure 1412 may be an opening in an end of the main body 141, and the assembly bracket 143 includes a hole site corresponding to a position of the outlet structure 1412. The sealing member 142 is between the opening of the outlet structure 1412 and the hole site of the assembly bracket 143 to realize sealing between the main body 141 and the assembly bracket 143, such that the water only flows out of the outlet structure 1412 to an exterior of the water guiding device 14.

In some embodiments, the auxiliary water tank 12 includes an exhaust hole 123 that vents under a preset condition and generates a pressure difference between the second water storage space 121 and the outside to discharge water in the second water storage space 121 through the outlet structure 1412. The auxiliary water tank 12 includes the exhaust hole 123 to discharge water out of the second water storage space 121 of the auxiliary water tank 12 through a water-absorbent cartridge or other water conductive structures by using the principle of air pressure difference, and the water drips on the rag to realize water replenishment for the rag. The above bionic principle using the air pressure difference allows for adaptive water replenishment after mopping according to different floor materials.

In addition, the water tank assembly 1 may further include a charging contact 18, and the charging contact 18 may be assembled on the main water tank 11 to supply power to the water pumping device 13. The charging contact 18 may be made of iron-nickel alloy. The main water tank 11 may include a top plate 118 opposite to the bottom plate 114, and the charging contact 18 may be on the top plate 118, avoiding interference with the structure of the auxiliary water tank 12, and facilitating electrical connection with the water pumping device 13 to supply the power.

The water tank assembly 1 is mounted to a sweeping-mopping robot through a snap 16, and may be quickly disassembled at any time to add water into the main water tank 11. The main water tank 11 may further include a water filling port 1181, and the water filling port 1181 is blocked by a sealing plug 17. During a water filling process, the sealing plug 17 is pulled out and the water is added through the water filling port 1181.

The present disclosure further provides a cleaning device that includes a main machine and the above water tank assembly 1. The water tank assembly 1 is assembled on the main machine, and a cleaning body 15 is assembled on the water tank assembly 1 and corresponds to the position of the outlet structure 1412.

In the above embodiment, the cleaning body 15 may be a rag, a cleaning sponge, a cleaning brush and the like, which is not limited in the present disclosure. Since the water tank assembly 1 includes the main water tank 11 and the auxiliary water tank 12, the water pumping device 13 in operation pumps and discharges the water in the first water storage space 115 of the main water tank 11 into the second water storage space 121 of the auxiliary water tank 12, and the water guiding device 14 in operation outputs the water from the second water storage space 121 to the cleaning body 15 corresponding to the position of the outlet structure 1412. The water pumping device 13 in operation supplies water to the auxiliary water tank 12 as needed. The main water tank 11 does not discharge water into the auxiliary water tank 12 when the water pumping device 13 is not in operation. As a result, the water amount in the auxiliary water tank 12 no longer increases, avoiding making the surroundings and the cleaning body 15 wet and avoiding the waste of water resources caused by continuous output of the water from the second water storage space 121. Since the water amount in the auxiliary water tank 12 no longer increases when the cleaning device is in a non-working state, the cleaning body 15 can become dry over time after the water in the auxiliary water tank 12 has drained away from the outlet structure 1412, thus avoiding mildew and odor and damage to the bottom plate 114.

In the above embodiment, the water pumping device 13 may be electrically coupled to a mainboard of the cleaning device, to automatically pump and discharge water through the control of the mainboard. For example, the mainboard may control the amount of water pumped and discharged, the pumping and discharging time, start-up, shutdown and other actions of the water pumping device 13, to add water into the second water storage space 121. It should be noted that the above water pumping and discharging process of the water pumping device 13 may be automatically controlled according to a preset procedure. For example, the water is added into the second water storage space 121 at a determined time and in a quantitative manner during operation of the cleaning device, and for example, the addition of water into the second water storage space 121 is stopped when the cleaning device is about to stop operating.

In some embodiments, the cleaning device further includes a bonding member 19 on the water tank assembly 1. The water tank assembly 1 is detachably assembled on the main machine, and the cleaning body 15 is bonded and fixed to the bonding member 19. Since the water tank assembly 1 is detachably assembled on the main machine, it is convenient to add water into the main water tank 11 and realize the cleaning, maintenance and replacement of the main water tank 11 and the auxiliary water tank 12. The bonding member 19 fixes the cleaning body 15 to the water tank assembly 1, which facilitates the disassembly and replacement of the cleaning body 15. The bonding member 19 may be a Velcro tape or other bonding structures, which is not limited in the present disclosure.

The present disclosure further provides a cleaning system, and the cleaning system includes a base station and the above cleaning device. The cleaning device is fitted in or separated from the base station.

The water tank assembly 1 of the above cleaning device includes the main water tank 11 and the auxiliary water tank 12. The water pumping device 13 in operation pumps the water in the first water storage space 115 of the main water tank 11 into the second water storage space 121 of the auxiliary water tank 12. The water guiding device 14 in operation outputs the water from the second water storage space 121 to a preset position. The water pumping device 13 in operation supplies water to the auxiliary water tank 12 as needed. The main water tank 11 does not discharge water into the auxiliary water tank 12 when the water pumping device 13 is not in operation. As a result, the water amount in the auxiliary water tank 12 no longer increases, avoiding making the surroundings and device wet and avoiding the waste of water resources caused by continuous output of the water from the second water storage space 121.

The above description merely elaborates some embodiments of the present disclosure and is not intended to limit the present disclosure. Any modification, equivalent substitution, improvement, and the like made within the principles of the present disclosure shall be included in the protection scope of the present disclosure.

The invention claimed is:

1. A water tank assembly, comprising:

a main water tank comprising a first water storage space;

an auxiliary water tank comprising a second water storage space;

a water pumping device comprising a pumping port and a drainage port, wherein the pumping port is in communication with the first water storage space, and the drainage port is in communication with the second water storage space to pump and discharge water in the first water storage space into the second water storage space; and a water guiding device comprising an inlet and an outlet structure, wherein the inlet is in communication with the second water storage space, and the outlet structure is in communication with an exterior of the water tank assembly to output water in the second water storage space, wherein the main water tank comprises a bottom plate facing the auxiliary water tank, and the auxiliary water tank is on the bottom plate; and the bottom plate comprises a drainage structure connecting an interior of the main water tank with the second water storage space, and the drainage port is coupled to the drainage structure.

2. The water tank assembly according to claim 1, wherein the main water tank comprises a first housing, and the water pumping device is inside the first housing.

3. The water tank assembly according to claim 2, wherein:

the first housing comprises the first water storage space, an assembling space, and a partition structure separating the first water storage space from the assembling space; and the water pumping device is in the assembling space.

4. The water tank assembly according to claim 3, wherein:

the first housing further comprises a first cover and a second cover, and the first cover and the second cover are fixed with each other by welding to form the sealed first water storage space; and the partition structure comprises a welding rib on at least one of the first cover and the second cover.

5. The water tank assembly according to claim 1, wherein the drainage structure is a tubular channel structure on the bottom plate, and the drainage port of the water pumping device is in communication with the tubular channel structure.

6. The water tank assembly according to claim 1, wherein:

the water guiding device further comprises a main body, a seal and an assembly bracket, and the inlet and the outlet structure are on the main body;

the main body is assembled on the assembly bracket, and the seal is between the main body and the assembly bracket; and the water guiding device is assembled on the auxiliary water tank through the assembly bracket.

7. The water tank assembly according to claim 6, wherein:

the outlet structure is an opening in an end of the main body, and the assembly bracket comprises a hole site corresponding to a position of the outlet structure; and the seal is between the opening of the outlet structure and the hole site of the assembly bracket.

8. The water tank assembly according to claim 1, wherein the auxiliary water tank comprises an exhaust hole, and the exhaust hole vents under a preset condition and generates a pressure difference between the second water storage space and the outside to discharge the water in the second water storage space through the outlet structure.

9. The water tank assembly according to claim 1, further comprising a charging contact assembled on the main water tank to supply power to the water pumping device.

10. The water tank assembly according to claim 9, wherein the main water tank comprises a top plate, and the charging contact is on the top plate.

11. The water tank assembly according to claim 1, wherein the main water tank comprises a water filling port, and the water filling port is blocked by a sealing plug.

12. A cleaning device, comprising:

a main machine;

a water tank assembly assembled on the main machine; and a cleaning body assembled on the water tank assembly and corresponding to a position of an outlet structure, wherein the water tank assembly comprises:

a main water tank comprising a first water storage space;

an auxiliary water tank comprising a second water storage space;

a water pumping device comprising a pumping port and a drainage port, wherein the pumping port is in communication with the first water storage space, and the drainage port is in communication with the second water storage space to pump and discharge water in the first water storage space into the second water storage space; and a water guiding device comprising an inlet and the outlet structure, wherein the inlet is in communication with the second water storage space, and the outlet structure is in communication with an exterior of the water tank assembly to output water in the second water storage space, wherein the main water tank comprises a bottom plate facing the auxiliary water tank, and the auxiliary water tank is on the bottom plate; and the bottom plate comprises a drainage structure connecting an interior of the main water tank with the second water storage space, and the drainage port is coupled to the drainage structure.

13. The cleaning device according to claim 12, further comprising a hook-and-loop tape on the water tank assembly, wherein the water tank assembly is detachably assembled on the main machine, and the cleaning body is bonded and fixed to the hook-and-loop tape.

14. The cleaning device according to claim 12, wherein the water tank assembly is mounted to the main machine through a snap.

15. The cleaning device according to claim 12, further comprising a mainboard, wherein the water pumping device is electrically coupled to the mainboard, to automatically pump and discharge water through control of the mainboard.

16. The cleaning device according to claim 12, wherein the cleaning body is a rag, a cleaning sponge, or a cleaning brush.

17. A cleaning system, comprising a base station and a cleaning device fitted in or separated from the base station, wherein the cleaning device comprises:

a main machine;

a water tank assembly assembled on the main machine; and a cleaning body assembled on the water tank assembly and corresponding to a position of an outlet structure, wherein the water tank assembly comprises:

a main water tank comprising a first water storage space;

an auxiliary water tank comprising a second water storage space;

a water pumping device comprising a pumping port and a drainage port, wherein the pumping port is in communication with the first water storage space, and the drainage port is in communication with the second water storage space to pump and discharge water in the first water storage space into the second water storage space; and a water guiding device comprising an inlet and the outlet structure, wherein the inlet is in communication with the second water storage space, and the outlet structure is in communication with an exterior of the water tank assembly to output water in the second water storage space, wherein the main water tank comprises a bottom plate facing the auxiliary water tank, and the auxiliary water tank is on the bottom plate; and the bottom plate comprises a drainage structure connecting an interior of the main water tank with the second water storage space, and the drainage port is coupled to the drainage structure.

* * * * *